US008593348B2

(12) United States Patent
Krupa et al.

(10) Patent No.: US 8,593,348 B2
(45) Date of Patent: Nov. 26, 2013

(54) DISTRIBUTED COUPLING ANTENNA

(75) Inventors: Steve Krupa, Tiberias (IL); Snir Azulay, Tiberias (IL)

(73) Assignee: Galtronics Corporation Ltd., Tiberias (IL)

( * ) Notice: Subject to any disclaimer, the term of this patent is extended or adjusted under 35 U.S.C. 154(b) by 82 days.

(21) Appl. No.: 13/203,109

(22) PCT Filed: Apr. 7, 2010

(86) PCT No.: PCT/IL2010/000291
§ 371 (c)(1),
(2), (4) Date: Nov. 4, 2011

(87) PCT Pub. No.: WO2010/116373
PCT Pub. Date: Oct. 14, 2010

(65) Prior Publication Data

US 2012/0044121 A1 Feb. 23, 2012

Related U.S. Application Data

(60) Provisional application No. 61/167,247, filed on Apr. 7, 2009.

(51) Int. Cl.
*H01Q 1/38* (2006.01)

(52) U.S. Cl.
USPC ..... 343/700 MS; 343/745; 343/846; 343/860

(58) Field of Classification Search
USPC ..... 343/700 MS, 745, 846, 850, 860
See application file for complete search history.

(56) References Cited

U.S. PATENT DOCUMENTS

| | | | | |
|---|---|---|---|---|
| 3,343,089 | A * | 9/1967 | Murphy et al. | 455/123 |
| 3,909,830 | A * | 9/1975 | Campbell | 343/703 |
| 4,876,522 | A | 10/1989 | Mitlmeier et al. | |
| 5,867,127 | A * | 2/1999 | Black et al. | 343/702 |
| 6,518,937 | B2 * | 2/2003 | Fang | 343/895 |
| 6,906,667 | B1 | 6/2005 | Poilasne et al. | |
| 6,958,729 | B1 | 10/2005 | Metz | |
| 7,091,907 | B2 | 8/2006 | Brachat | |
| 7,190,322 | B2 * | 3/2007 | Apostolos et al. | 343/841 |
| 7,408,512 | B1 | 8/2008 | Rodenbeck et al. | |

(Continued)

FOREIGN PATENT DOCUMENTS

| | | | |
|---|---|---|---|
| WO | WO 2008/054108 | A1 | 5/2008 |
| WO | WO 2010/044086 | A1 | 4/2010 |
| WO | WO 2010/116373 | A1 | 10/2010 |

OTHER PUBLICATIONS

Bank, M. et al., "Cell Phone Antennas, Problems and Solutions", Proceedings of the 3rd International Conference on Communications and Information Technology, p. 1-3, Dec. 2009.

(Continued)

*Primary Examiner* — David G Phan
(74) *Attorney, Agent, or Firm* — Sughrue Mion, PLLC

(57) ABSTRACT

An antenna including a ground plane region, a feed element having associated with it a first reactance and a coupling element having associated with it a second reactance, the second reactance being of opposite sign to the first reactance, the coupling element being coupled to the feed element and to the ground plane region and being located in close proximity to the ground plane region, wherein an impedance and hence a resonant frequency of the antenna depend on the first and second reactances.

29 Claims, 3 Drawing Sheets

(56) References Cited

U.S. PATENT DOCUMENTS

| | | | | |
|---|---|---|---|---|
| 7,592,957 | B2 | 9/2009 | Achour et al. | |
| 2003/0098812 | A1 | 5/2003 | Ying et al. | |
| 2007/0194995 | A1 | 8/2007 | Fang et al. | |
| 2007/0222697 | A1 | 9/2007 | Caimi et al. | |
| 2007/0268191 | A1 | 11/2007 | Ishizuka et al. | |
| 2008/0012579 | A1 | 1/2008 | Kuhns et al. | |
| 2008/0048917 | A1 | 2/2008 | Achour et al. | |
| 2008/0088517 | A1 | 4/2008 | Ansari et al. | |
| 2008/0169349 | A1 | 7/2008 | Suzuki et al. | |
| 2008/0291111 | A1 | 11/2008 | Bae et al. | |
| 2010/0109971 | A2 | 5/2010 | Gummalla et al. | |
| 2010/0109972 | A2 | 5/2010 | Xu et al. | |
| 2010/0156963 | A1 | 6/2010 | Shiomi | |
| 2010/0283705 | A1 | 11/2010 | Achour et al. | |
| 2011/0122027 | A1* | 5/2011 | Wong et al. | 343/700 MS |

OTHER PUBLICATIONS

Caloz, C. et al., "Application of the transmission line theory of left-handed (LH) materials to the realization of a microstrip LH line", IEEE University of California, p. 412-415, 2002.

Caloz, C. et al., "Transmission Line Approach of the Left-Handed (LH) Materials and Microstrip Implementation of an Artifical LH Transmission Line", IEEE, vol. 52, No. 5, p. 1159-1163, May 2004.

Haridim, M. et al., "Highly efficient SAR reduction using PIFA and MB antenna in mobile handsets", Proceedings of the 3rd International Conference on Communications and Information Technology, p. 165-167, Dec. 2009.

International Preliminary Report on Patentability dated Apr. 7, 2010 issued in International Application No. PCT/IL2010/000291.

Lai, A. et al., "Infinite Wavelength Resonant Antennas With Monopolar Radiation Pattern Based on Periodic Structures", IEEE, vol. 55, No. 3, p. 868-876, Mar. 2007.

Lee, C. H. et al., "Design of Resonant Small Antenna Using Composite Right/Left-Handed Transmission Line", IEEE, p. 218-221, 2005.

Lee, J. et al., "Low profile Omnidirectional Zeroth-order Resonator (ZOR) antenna", Hongik University, Korea, p. 2029-2032, 2006.

Li, C. et al., "Analysis of Composite Right/Left-handed Coplanar Waveguide Zeroth-order Resonators with Application to a Band-pass Filter", Chinese Academy of Science, Beijing, China, PIERS Online, Vo. 3. No. 5, p. 599-602, 2007.

Liu, Q. "Antennas Using Left Handed Transmission Lines", A thesis submitted to the University of Birmingham, p. 1-220, Dec. 2009.

Sanada, A. et al., "Novel Zeroth-Order Resonance in Composite Right/Left-handed Transmission Line Resonators", University of California, 2003.

Vrba, D. et al., "Radiation Efficiency of the Metamaterial Zero-order Resonator Antenna", PIERS Proceedings, Cambridge, USA, p. 482-485, Jul. 2008.

Wu, B. I. et al., "A Study of Using Metamaterials as Antenna Substrate to Enhance Gain", Progress in Electromagnetics Research, PIER 51, 295-328, 2005.

Yang, L. et al., "A Novel Compact Electromagnetic-Bandgap (EBG) Structure and Its Applications for Microwave Circuits", vol. 53, No. 1, p. 183-190, Jan. 2005.

Ziolkowski, R. W. et al., "An Efficient, Electrically Small Antenna Designed for VHF and UHF Applications", IEEE, vol. 7, p. 217-220, 2008.

Ziolkowski, R. W. et al., "Metamaterial-Based Efficient Electrically Small Antennas", IEEE, vol. 54, No. 7, p. 2113-2130, Jul. 2006.

International Search Report of PCT/IL2010/00291 dated Jul. 15, 2010.

* cited by examiner

DISTRIBUTED COUPLING ANTENNA

REFERENCE TO RELATED APPLICATIONS

Reference is hereby made to U.S. Provisional Patent Application 61/167,247, entitled DISTRIBUTED COUPLING ANTENNA, filed Apr. 7, 2009, the disclosure of which is hereby incorporated by reference and priority of which is hereby claimed pursuant to 37 CFR 1.78(a)(4) and (5)(i).

FIELD OF THE INVENTION

The present invention relates generally to antennas and more particularly to compact low frequency antennas.

BACKGROUND OF THE INVENTION

The following patent documents are believed to represent the current state of the art:

U.S. Pat. No. 4,876,552 and U.S. Pat. No. 7,091,907.

SUMMARY OF THE INVENTION

The present invention seeks to provide an improved compact low frequency antenna for use in wireless communication devices.

There is thus provided in accordance with a preferred embodiment of the present invention an antenna including a ground plane region, a feed element having associated with it a first reactance and a coupling element having associated with it a second reactance, the second reactance being of opposite sign to the first reactance, the coupling element being coupled to the feed element and to the ground plane region and being located in close proximity to the ground plane region, wherein an impedance and hence a resonant frequency of the antenna depend on the first and second reactances.

In accordance with a preferred embodiment of the present invention the feed element includes an inductive feed element and the first reactance includes an inductive reactance and the coupling element includes a capacitive coupling element and the second reactance includes a capacitive reactance.

Preferably, radio frequency electric fields are generated by the capacitive coupling element.

Preferably, the capacitive coupling element is coupled to the ground plane region by way of capacitive coupling of the radio frequency electric fields.

Preferably, the capacitive coupling is distributed over a significant portion of the ground plane region, such that currents are excited on the significant portion of the ground plane region.

In accordance with a preferred embodiment of the present invention the inductive feed element and the capacitive coupling element have planar geometry.

Preferably, the inductive feed element and the capacitive coupling element are formed on a surface of a PCB.

Preferably, the inductive feed element includes a planar spiral. Additionally or alternatively, the capacitive coupling element includes a planar finger.

In accordance with another preferred embodiment of the present invention the capacitive coupling element has three-dimensional geometry and is formed on a surface of a substrate other than a PCB.

Preferably, the substrate has high dielectric permittivity.

Preferably, the capacitive coupling element includes interdigitated fingers separated by a non-conductive gap.

In accordance with a further preferred embodiment of the present invention the feed element includes a capacitive feed element and the first reactance includes a capacitive reactance and the coupling element includes an inductive coupling element and the second reactance includes an inductive reactance.

Preferably, radio frequency magnetic fields are generated by the inductive coupling element.

Preferably, the inductive coupling element is coupled to the ground plane region by way of inductive coupling of the radio frequency magnetic fields.

Preferably, the inductive coupling is distributed over a significant portion of the ground plane region, such that currents are excited on the significant portion of the ground plane region.

In accordance with a preferred embodiment of the present invention the capacitive feed element and the inductive coupling element have planar geometry.

Preferably, the capacitive feed element and the inductive coupling element are formed on a surface of a PCB.

Preferably, the capacitive feed element includes intermeshed capacitive combs. Additionally or alternatively, the inductive coupling element includes a planar spiral.

In accordance with another preferred embodiment of the present invention the inductive coupling element has three-dimensional geometry and is formed on a surface of a substrate other than a PCB.

Preferably, the inductive coupling element includes at least two inductively coupled coils.

In accordance with yet another preferred embodiment of the present invention the feed element is galvanically connected to a radio frequency input point by way of a feedline, the feedline preferably including circuit-matching components.

Alternatively, the feed element is non-galvanically connected to a radio frequency input point.

In accordance with yet a further preferred embodiment of the present invention the coupling element is galvanically connected to the ground plane region.

Preferably, the antenna also includes a tuning mechanism.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
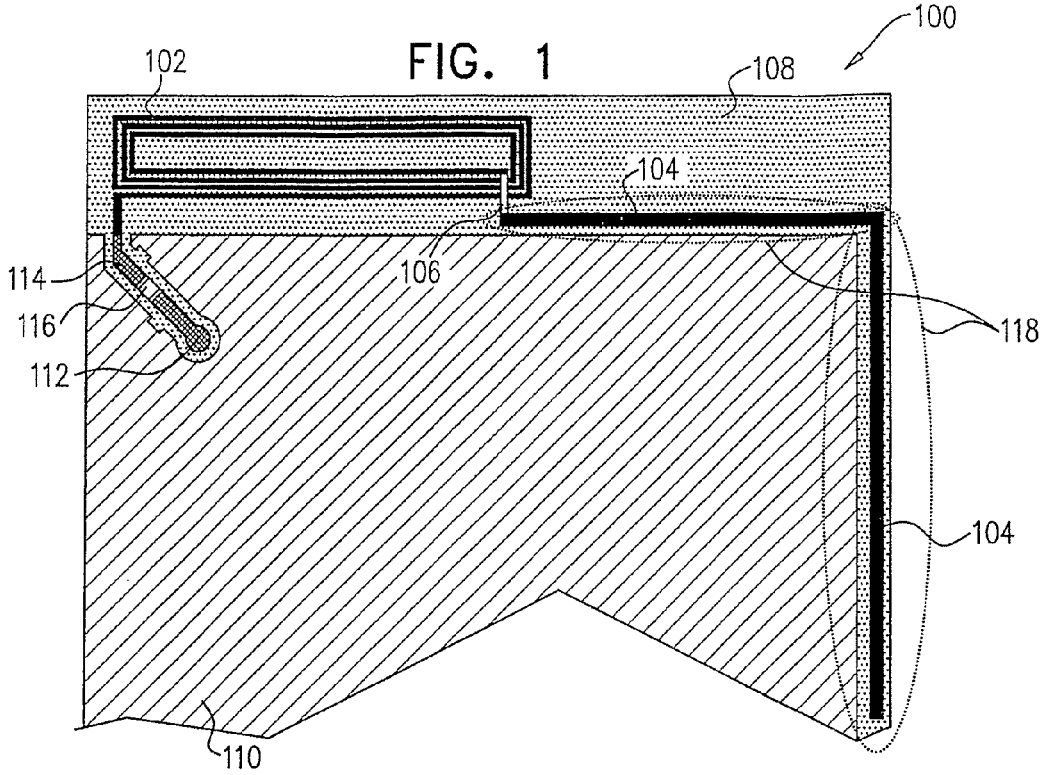
FIG. 1 is a schematic illustration of an antenna constructed and operative in accordance with a preferred embodiment of the present invention.

Reference is now made to FIG. 1, which is a schematic illustration of an antenna constructed and operative in accordance with an embodiment of the present invention.

As seen in FIG. 1, there is provided an antenna 100, including a feed element 102 and a coupling element 104, preferably mutually connected by a jumper 106. Feed element 102 and coupling element 104 are preferably located on a common surface of a printed circuit board (PCB) 108 having a ground plane region 110. In the embodiment illustrated in FIG. 1, feed element 102 and coupling element 104 are arranged in a series combination. It is appreciated, however, that other arrangements of feed element 102 and coupling element 104 are also possible.

Feed element 102 and coupling element 104 are preferably structures capable of storing energy via the concentration of electric or magnetic fields, each element having associated with it a net effective reactance. The net effective reactance associated with feed element 102 is preferably similar in magnitude and opposite in sign to the net effective reactance associated with coupling element 104. In the embodiment shown in FIG. 1, feed element 102 is preferably an inductive element having an associated positive inductive reactance and coupling element 104 is preferably a capacitive element having an associated negative capacitive reactance. The inductive reactance associated with feed element 102 and the capacitive reactance associated with coupling element 104 contribute to the net impedance of antenna 100, thereby generating a resonant response in antenna 100, as will be described in greater detail below.

Feed element 102 is preferably embodied as an inductive planar spiral loop and is preferably galvanically connected to a radio frequency (RF) input point 112 by way of a feedline 114, which feedline 114 preferably includes a matching circuit component 116. Alternatively, feed element 102 may be connected to RF input point 112 by way of a non-galvanic connection. RF input point 112 is preferably a 50 Ohm RF connection point, although it is appreciated that antenna 100 may be configured so as to be compatible with other input impedances.

The net effective inductance of the spiral loop comprising feed element 102 is preferably dependent on several parameters, including the length and width of the spiral track, the separation between adjacent turns of the spiral track, the width to length aspect ratio of the spiral loops and the optional inclusion of discrete reactive components, such as inductors and capacitors, within the body of the spiral loop.

Coupling element 104 is preferably embodied as a narrow planar finger located in close proximity to, although not in contact with, ground plane region 110, thereby forming a structure having a distributed shunt capacitance between it and ground plane region 110. Coupling element 104 is preferably capacitively coupled to ground plane region 110 by way of RF electric fields 118, which RF electric fields 118 are generated by coupling element 104. Due to the close proximity of coupling element 104 to ground plane region 110, the capacitive coupling therebetween is distributed over a significant portion of ground plane region 110. This distributed capacitive coupling leads to the generation of excited currents on a significant portion of ground plane region 110, thereby enhancing the operating efficiency of antenna 100.

In order to generate the maximum intensity of excited currents on ground plane region 110, coupling element 104 preferably extends along a significant portion of the perimeter of ground plane region 110, as shown in FIG. 1.

Coupling element 104 may be optionally additionally coupled to ground plane region 110 by way of a galvanic connection.

The net effective capacitance between the coupling element 104 and the ground plane region 110 is preferably dependent on several parameters, including the width and length of the capacitive finger, the size of the gap separating coupling element 104 from ground plane region 110 and the substrate material and thickness of PCB 108.

The net effective respective inductance and capacitance of feed element 102 and coupling element 104 may further be varied by the inclusion of high dielectric permittivity or high magnetic permeability materials in antenna 100, in close proximity to feed element 102 and/or coupling element 104. For example, feed element 102 may include a high magnetic permeability ferrite loading slug and coupling element 104 may be formed on a high dielectric permittivity base. The inclusion of high permittivity or permeability materials in antenna 100 allows the size of antenna 100 to be reduced, although at the possible expense of a reduction in its operating efficiency and/or bandwidth.

At a given RF frequency, typically below 750 MHz, the positive inductive reactance associated with feed element 102 preferably cancels the negative capacitive reactance associated with coupling element 104, thereby generating a low frequency resonant response in antenna 100. To ensure a good impedance match between antenna 100 and the RF radio system to which it is connected, the various parameters detailed above may be adjusted so as to achieve a suitable input impedance, which is typically and preferably 50 Ohms+ j0 Ohms.

The determination of the impedance and hence resonant frequency of antenna 100 by the net effective inductive and capacitive reactances associated with the feed and coupling elements is in contrast to conventional antennas employed in wireless devices, in which the resonant frequency is typically determined by the electrical length of certain antenna components. This feature of the present invention allows antenna 100 to be successfully implemented on device ground planes having dimensions substantially less than $1/10^{th}$ of the operating wavelength of antenna 100 and on ground plane structures heavily fragmented by PCB signal traces.

In the case that antenna 100 is employed in a wireless device having more than one antenna system, filter components may be incorporated into feed element 102 in order to increase the isolation of antenna 100 and improve its performance. Such filter components may be added either in the form of discrete surface mount technology (SMT) components or as distributed frequency constraining elements.

Antenna 100 may be formed directly on the surface PCB 108 by printing or other similar techniques, or mounted on a three-dimensional carrier made from a low dielectric material.

Figure 2:
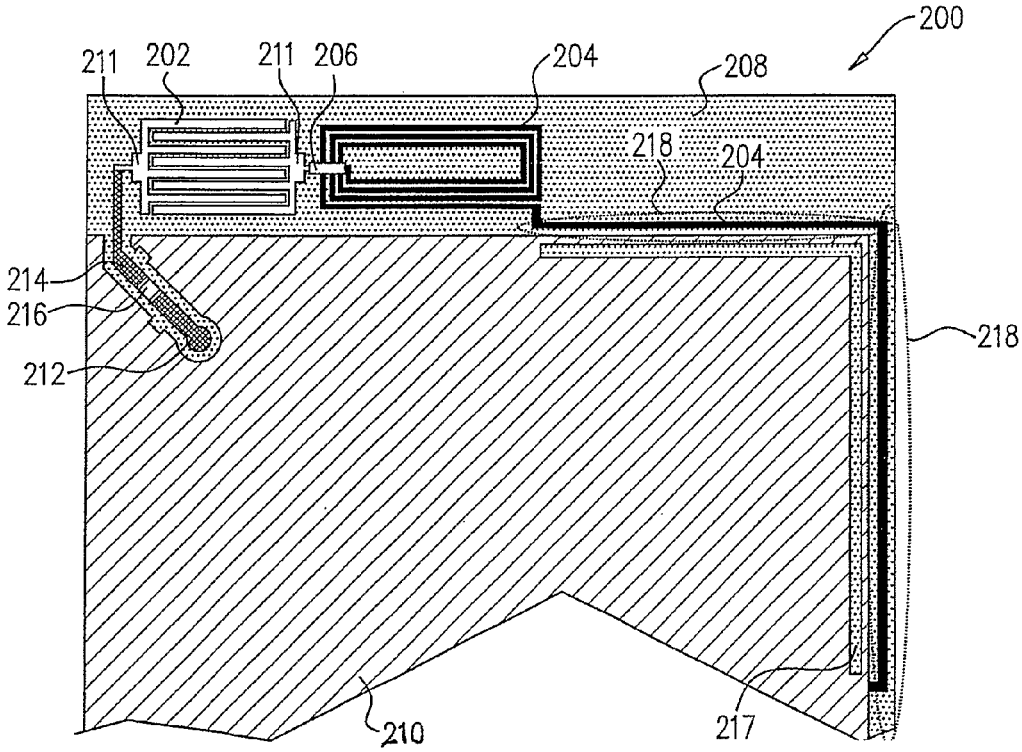
FIG. 2 is a schematic illustration of an antenna constructed and operative in accordance with another preferred embodiment of the present invention.

Reference is now made to FIG. 2, which is a schematic illustration of an antenna constructed and operative in accordance with another embodiment of the present invention.

As seen in FIG. 2, there is provided an antenna 200, including a feed element 202 and a coupling element 204, preferably mutually connected by a jumper 206. Feed element 202 and coupling element 204 are preferably located on a common surface of a PCB 208 having a ground plane region 210.

Feed element 202 is preferably a capacitive feed element and is preferably embodied in the form of intermeshed capacitive combs 211. Feed element 202 is preferably galvanically connected to an RF input point 212 by way of a feedline 214, which feedline 214 preferably includes a matching circuit component 216. Alternatively, feed element 202 may be connected to RF input point 212 by way of a non-galvanic connection.

Coupling element 204 is preferably an inductive coupling element and is preferably embodied in the form of an inductive planar spiral located in close proximity to ground plane region 210. A corresponding inductive loop is preferably formed on ground plane region 210 due to the presence of a gap 217, through which gap 217 a portion of PCB 208 is visible. Coupling element 204 is preferably inductively coupled to the ground plane region 210 by way of distributed coupling of RF magnetic fields 218. In the embodiment shown in FIG. 2, coupling element 204 is galvanically connected to ground plane region 210. It is appreciated, however, that coupling element 204 may alternatively be coupled to ground plane region 210 by way of a non-galvanic connection, for example by way of a shunt capacitive coupler that may be added at one end of coupling element 204.

Antenna 200 may resemble antenna 100 of FIG. 1 in every relevant respect, with the exception of the nature of the feed and coupling elements. In contrast to antenna 100, in which the feed element 102 is inductive and the coupling element 104 is capacitive, in antenna 200 the feed element 202 is capacitive and the coupling element 204 is inductive. As a result, the distributed coupling between the inductive coupling element 204 and ground plane region 210 is by way of RF magnetic fields in antenna 200 as opposed to by way of RF electric fields in antenna 100.

Other features and advantages of antenna 200 are as described above in reference to antenna 100.

Figure 3:
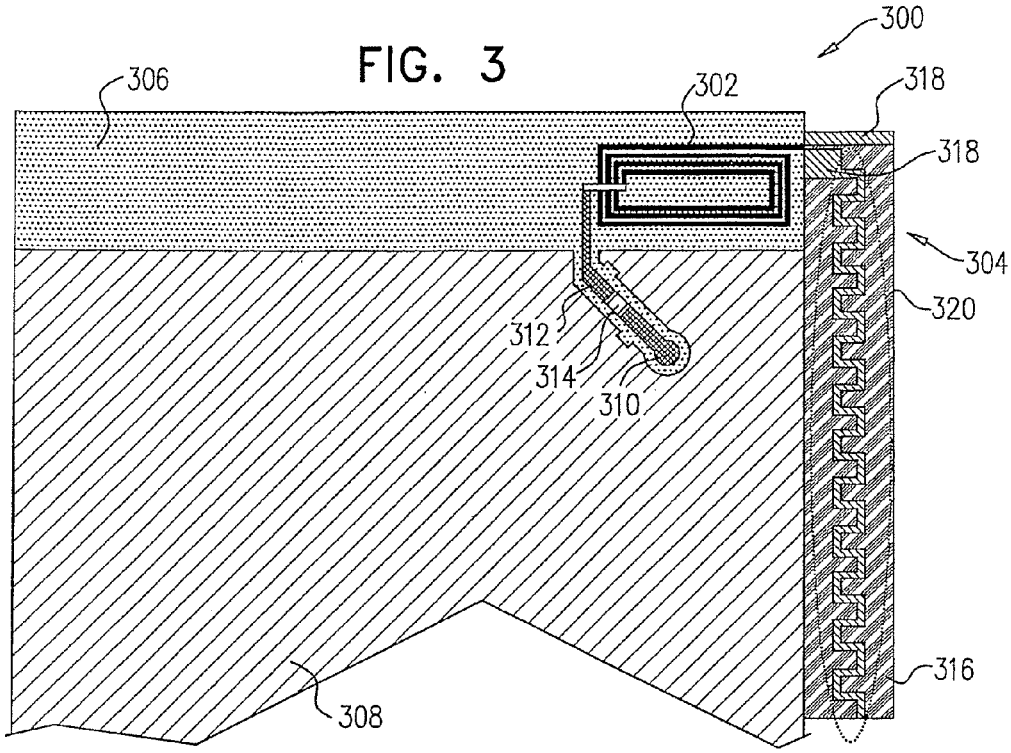
FIG. 3 is a schematic illustration of an antenna constructed and operative in accordance with yet another preferred embodiment of the present invention.

Reference is now made to FIG. 3, which is a schematic illustration of an antenna constructed and operative in accordance with yet another embodiment of the present invention.

As seen in FIG. 3, there is provided an antenna 300, including a feed element 302 and a coupling element 304. Feed element 302 is preferably galvanically connected to coupling element 304 and is located on a surface of a PCB 306 having a ground plane region 308.

Feed element 302 is preferably an inductive feed element and is preferably embodied in the form of a planar inductive spiral. Feed element 302 is preferably galvanically connected to an RF input point 310 by way of a feedline 312, which feedline 312 preferably includes a matching circuit component 314. Alternatively, feed element 302 may be connected to RF input point 310 by way of a non-galvanic connection.

Coupling element 304 is preferably a capacitive coupling element and is preferably embodied in the form of interdigitated fingers 316 mutually separated by non-conductive regions 318, thus forming a capacitive structure. Coupling element 304 is preferably mounted on the surface of a dielectric substrate, such as a Flex Film, and may lie parallel or perpendicular to the plane of PCB 306, depending on the design requirements of antenna 300. Coupling element 304 is preferably capacitively coupled to the ground plane region 308 by way of distributed coupling of RF electric fields 320.

Antenna 300 may resemble antenna 100 of FIG. 1 in every relevant respect, with the exception of the design of coupling element 304. In contrast to antenna 100, in which the coupling element 104 is preferably embodied as a planar structure formed directly on the surface of the PCB 108, in antenna 300 the coupling element 304 is preferably embodied as a three-dimensional off-PCB structure mounted on a substrate separate from PCB 306.

Other features and advantages of antenna 300 are as described above in reference to antenna 100.

Figure 4:
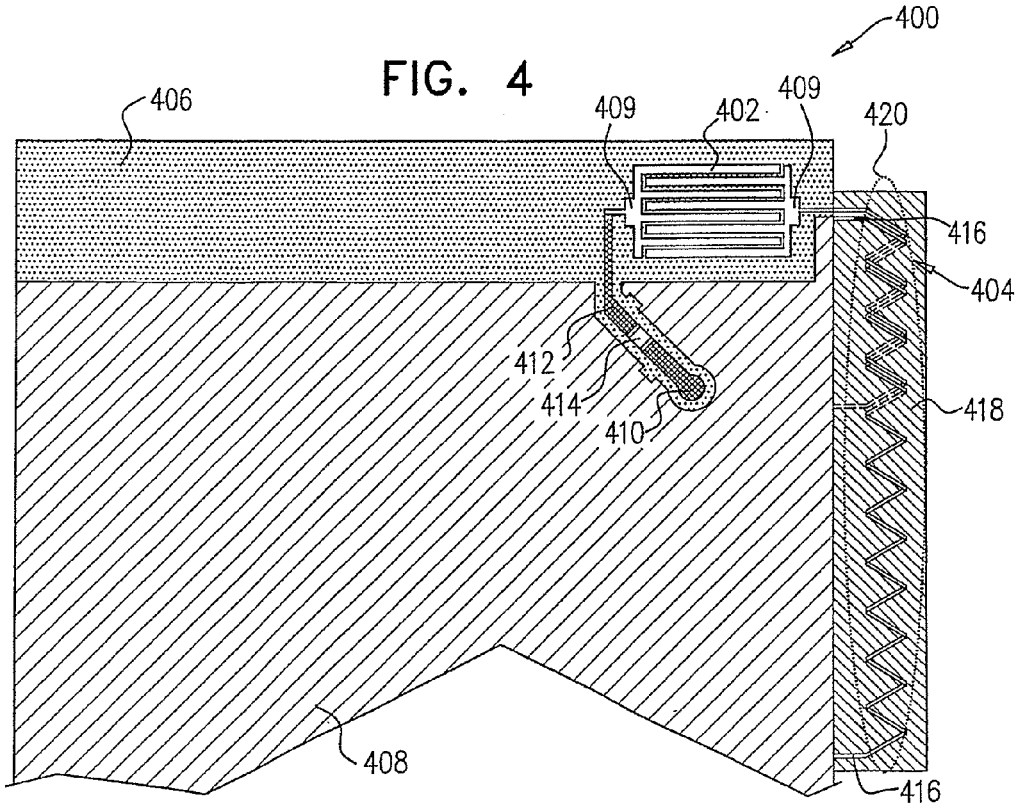
FIG. 4 is a schematic illustration of an antenna constructed and operative in accordance with still another preferred embodiment of the present invention.

Reference is now made to FIG. 4, which is a schematic illustration of an antenna constructed and operative in accordance with still another embodiment of the present invention.

As seen in FIG. 4, there is provided an antenna 400, including a feed element 402 and a coupling element 404.

Feed element 402 is preferably located on a surface of a PCB 406 having a ground plane region 408 and is preferably a capacitive feed element, embodied in the form of intermeshed capacitive combs 409. Feed element 402 is preferably galvanically connected to an RF input point 410 by way of a feedline 412, which feedline 412 preferably includes a matching circuit component 414. Alternatively, feed element 402 may be connected to RF input point 410 by way of a non-galvanic connection.

Coupling element 404 is preferably an inductive coupling element and preferably has an inductively coupled loop topology, including two intermeshed planar inductive coils 416, the longer of which preferably terminates on ground plane region 408 at both of its ends and the shorter of which preferably galvanically connects coupling element 404 to feed element 402. Further details pertaining to the inductively coupled loop topology of coils 416 are disclosed in PCT Patent Application No. PCT/IL2009/001180, assigned to the same assignee as the present invention.

Inductive coils 416 are preferably mounted on the surface of a dielectric substrate 418, which substrate may be configured so as to be parallel or perpendicular to the plane of PCB 406, depending on the design requirements of antenna 400. Coupling element 404 is preferably inductively coupled to the ground plane region 408 by way of distributed coupling of RF magnetic fields 420.

Antenna 400 may resemble antenna 200 of FIG. 2 in every relevant respect, with the exception of the design of coupling element 404. In contrast to antenna 200, in which the coupling element 204 is preferably embodied as a planar structure formed directly on the surface of the PCB 208, in antenna 400 the coupling element 404 is preferably embodied as a three-dimensional off-PCB structure mounted on a substrate separate from PCB 406.

Other features and advantages of antenna 400 are as described above in reference to antenna 200.

Figure 5A:
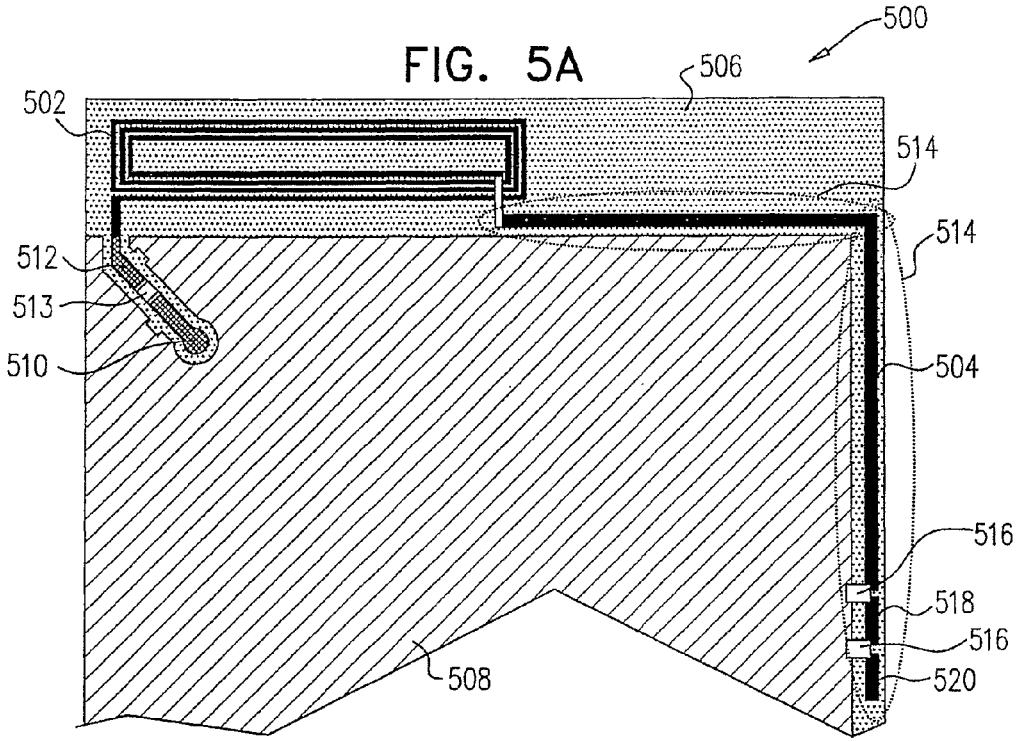
FIG. 5A is a schematic illustration of an antenna of the type illustrated in FIG. 1, including a tuning mechanism.
Figure 5B:
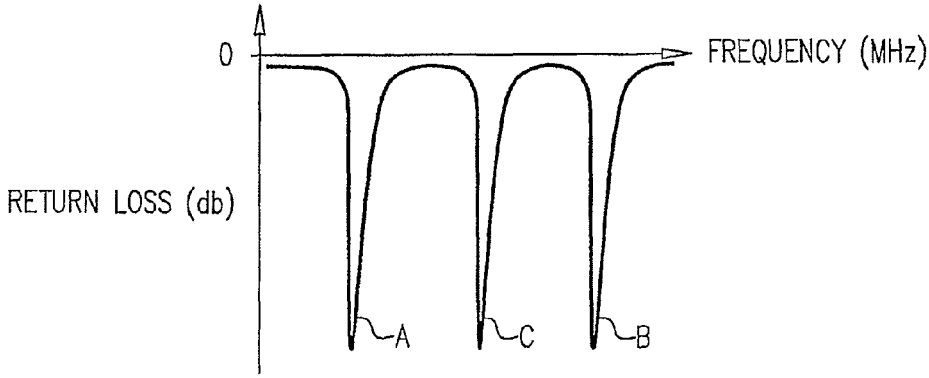
FIG. 5B is a graph indicating a change in the resonant frequency of the antenna of FIG. 5A responsive to control signals from the tuning mechanism.

Reference is now made to FIG. 5A, which is a schematic illustration of an antenna of the type illustrated in FIG. 1, including a tuning mechanism, and to FIG. 5B, which is a graph indicating a change in the resonant frequency of the antenna of FIG. 5A responsive to control signals from the tuning mechanism.

As seen in FIG. 5A, there is provided an antenna 500 including a feed element 502 and a coupling element 504, preferably mutually galvanically connected and located on a common surface of a PCB 506 having a ground plane region 508. Feed element 502 is preferably an inductive feed element and is preferably connected to an RF input point 510 by way of a feedline 512, which feedline 512 preferably includes a matching circuit component 513. Coupling element 504 is preferably a capacitive coupling element and is preferably capacitively connected to ground plane region 508 by way of distributed coupling of RF electric fields 514.

The resonant frequency of antenna 500 may be adjusted by way of control signals delivered by a tuning mechanism. In the embodiment shown in FIG. 5A, a simple tuning mechanism is employed including two RF switches 516. RF switches 516 are preferably located along a terminal portion of coupling element 504 and are preferably operative to sequentially connect or disconnect end portions 518 and 520 to or from coupling element 504, thereby adjusting the overall length and capacitance of coupling element 504 and thus modifying the resonant frequency of antenna 500.

In the case that both of end portions 518 and 520 are connected to coupling element 504 by way of RF switches 516, coupling element 504 assumes its maximum length having maximum relative capacitance and lowest relative resonant frequency, as indicated by resonant peak A in FIG. 5B.

Conversely, in the case that both of end portions 518 and 520 are disconnected from coupling element 504 by way of RF switches 516, coupling element 504 assumes its minimum length having minimum relative capacitance and highest relative resonant frequency, as indicated by resonant peak B in FIG. 5B.

In the case that end portion 518 is connected to coupling element 504 but end portion 520 is disconnected from coupling element 504 by way of RF switches 516, coupling element 504 assumes an intermediate length having intermediate capacitance and intermediate resonant frequency, as indicated by resonant peak C in FIG. 5B.

It is appreciated that in addition to the simple tuning mechanism described herein, a variety of alternative tuning mechanisms for adjusting the resonance of antennas 100-500 may be employed and are included within the scope of the invention.

Other features and advantages of antenna 500 are as described above in reference to antenna 100.

It will be appreciated by persons skilled in the art that the present invention is not limited by what has been particularly claimed hereinbelow. Rather the scope of the present invention includes various combinations and subcombinations of the features described hereinabove as well as modifications and variations thereof as would occur to persons skilled in the art upon reading the foregoing description with reference to the drawings and which are not in the prior art.

The invention claimed is:

1. An antenna comprising:

a ground plane region;

a feed element having associated with it a first reactance; and a coupling element having associated with it a second reactance, said second reactance being of similar magnitude and opposite sign to said first reactance so as to cancel said first reactance, said coupling element being coupled to said feed element and to said ground plane region and being located in close proximity to said ground plane region, wherein an impedance and hence a resonant frequency of the antenna depend on said first and second reactances.

2. An antenna according to claim 1, wherein said feed element comprises an inductive feed element and said first reactance comprises an inductive reactance.

3. An antenna according to claim 2, wherein said coupling element comprises a capacitive coupling element and said second reactance comprises a capacitive reactance.

4. An antenna according to claim 3, wherein radio frequency electric fields are generated by said capacitive coupling element.

5. An antenna according to claim 4, wherein said capacitive coupling element is coupled to said ground plane region by way of capacitive coupling of said radio frequency electric fields.

6. An antenna according to claim 5, wherein said capacitive coupling is distributed over a significant portion of said ground plane region, such that currents are excited on said significant portion of said ground plane region.

7. An antenna according to claim 3, wherein said inductive feed element and said capacitive coupling element have planar geometry.

8. An antenna according to claim 7, wherein said inductive feed element and said capacitive coupling element are formed on a surface of a PCB.

9. An antenna according to claim 7, wherein said inductive feed element comprises a planar spiral.

10. An antenna according to claim 7, wherein said capacitive coupling element comprises a planar finger.

11. An antenna according to claim 3, wherein said capacitive coupling element has three-dimensional geometry and is formed on a surface of a substrate other than a PCB.

12. An antenna according to claim 11, wherein said substrate has high dielectric permittivity.

13. An antenna according to claim 11, wherein said capacitive coupling element comprises interdigitated fingers separated by a non-conductive gap.

14. An antenna according to claim 1, wherein said feed element comprises a capacitive feed element and said first reactance comprises a capacitive reactance.

15. An antenna according to claim 14, wherein said coupling element comprises an inductive coupling element and said second reactance comprises an inductive reactance.

16. An antenna according to claim 15, wherein radio frequency magnetic fields are generated by said inductive coupling element.

17. An antenna according to claim 16, wherein said inductive coupling element is coupled to said ground plane region by way of inductive coupling of said radio frequency magnetic fields.

18. An antenna according to claim 17, wherein said inductive coupling is distributed over a significant portion of said ground plane region, such that currents are excited on said significant portion of said ground plane region.

19. An antenna according to claim 15, wherein said capacitive feed element and said inductive coupling element have planar geometry.

20. An antenna according to claim 19, wherein said capacitive feed element and said inductive coupling element are formed on a surface of a PCB.

21. An antenna according to claim 19, wherein said capacitive feed element comprises intermeshed capacitive combs.

22. An antenna according to claim 19, wherein said inductive coupling element comprises a planar spiral.

23. An antenna according to claim 15, wherein said inductive coupling element has three-dimensional geometry and is formed on a surface of a substrate other than a PCB.

24. An antenna according to claim 23, wherein said inductive coupling element comprises at least two inductively coupled coils.

25. An antenna according to claim 1, wherein said feed element is galvanically connected to a radio frequency input point by way of a feedline.

26. An antenna according to claim 25, wherein said feedline includes circuit-matching components.

27. An antenna according to claim 1, wherein said feed element is non-galvanically connected to a radio frequency input point.

28. An antenna according to claim 1, wherein said coupling element is galvanically connected to said ground plane region.

29. An antenna according to claim 1, also comprising a tuning mechanism.

* * * * *

UNITED STATES PATENT AND TRADEMARK OFFICE

CERTIFICATE OF CORRECTION

PATENT NO. : 8,593,348 B2
APPLICATION NO. : 13/203109
DATED : November 26, 2013
INVENTOR(S) : Krupa et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 112 days.

Signed and Sealed this
Twenty-second Day of September, 2015

Michelle K. Lee

Michelle K. Lee
*Director of the United States Patent and Trademark Office*